United States Patent [19]

Langsford

[11] 4,138,789

[45] Feb. 13, 1979

[54] HAMMER TYPE IGNITION SYSTEM

[76] Inventor: Arthur W. Langsford, 306 Morish St., Broken Hill, New South Wales, Australia

[21] Appl. No.: 813,508

[22] Filed: Jul. 7, 1977

[51] Int. Cl.[2] ..... F41C 19/00

[52] U.S. Cl. ..... 42/65; 102/69

[58] Field of Search ..... 42/65, 69 R, 69 B

[56] References Cited

U.S. PATENT DOCUMENTS

| | | | |
|---|---|---|---|
| 808,214 | 12/1905 | Putnam | 42/69 R |
| 1,972,763 | 9/1934 | Dutton | 42/65 |
| 3,740,885 | 6/1973 | Leaman | 42/65 |

*Primary Examiner*—Charles T. Jordan
*Attorney, Agent, or Firm*—Jay L. Chaskin

[57] ABSTRACT

A hammer type ignition system for a firearm having a hammer pivoted about a pivot pin characterized by a floating cam also pivoted about said pivot pin and pivotally movable relative to the hammer, co-operable means on the hammer and cam limiting said relative pivotal movement therebetween, and a sear engaging surface on the cam releasably engageable by the sear of a firearm trigger.

7 Claims, 5 Drawing Figures

HAMMER TYPE IGNITION SYSTEM

This invention relates to a hammer type ignition system for a firearm which is particularly useful for a target pistol, and to a target pistol which incorporates such a system.

BACKGROUND OF THE INVENTION

One of the problems which is encountered in target shooting with a pistol is the human reaction which causes a shooter to flinch or slightly move his hand, at or about the time the trigger movement releases the hammer. I have observed that much greater accuracy can be achieved if the hammer travels through a shorter distance and therefore for a shorter period of time, and the main object of this invention is to provide improvements which will achieve this result.

BRIEF SUMMARY OF THE INVENTION

Briefly, in this invention, a hammer type ignition system for a firearm having a hammer pivoted about a pivot pin is characterised by a floating cam also pivoted about said pivot pin and pivotally movable relative to the hammer, co-operable means on the hammer and cam limiting said relative pivotal movement therebetween, and a sear engaging surface on the cam releasably engageable by the sear of a firearm trigger.

The limited relative movement between the hammer and the cam enables the hammer to be positioned at a location which will limit the hammer travel to be less than previously. In some embodiments the hammer spring is either replaced or is aided by another spring.

BRIEF DESCRIPTION OF THE DRAWINGS

The invention may take several forms, and several embodiments are therefore described hereunder with respect to and are illustrated in the accompanying drawings, in which.

Figure 1:
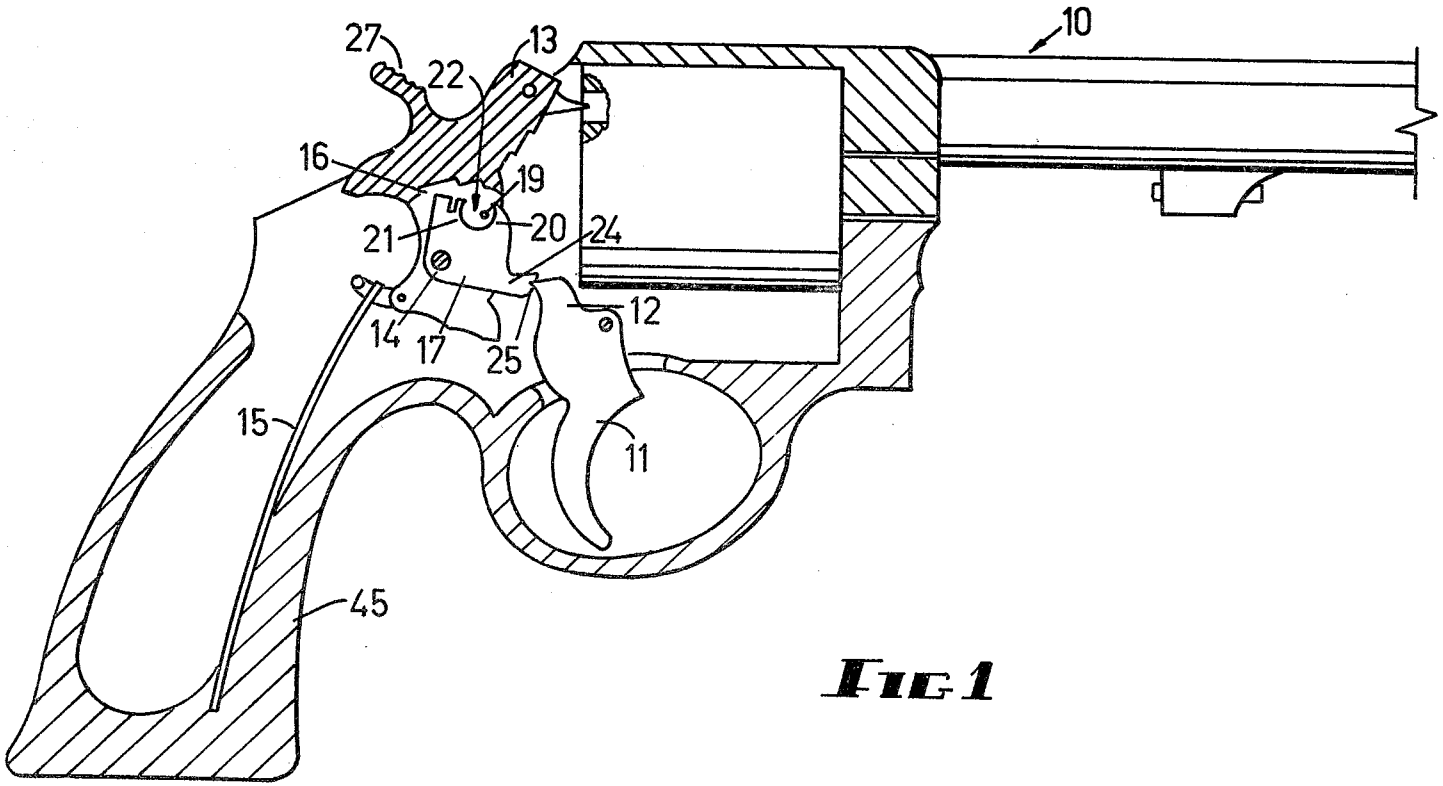
FIG. 1 is a partly sectioned elevation of a target pistol according to a first embodiment.

In the first embodiment illustrated in FIG. 1 a pistol 10 of well known make was modified. The pistol 10 was of the type utilising a pivoted trigger 11 having thereon a sear 12 co-operable with a sear engaging surface constituted by a slot (or notch) extending across a hammer 13 which itself was pivoted on a pivot pin 14 and driven forwardly by a leaf spring 15 (FIG. 1). In this embodiment a slot 16 is formed in the hammer, and a floating pawl cam 17 is positioned within the slot 16, the floating pawl cam 17 having a pivot aperture extending through it, the floating cam 17 being positioned over the hammer pivot pin 14 along with the hammer and being freely movable within the slot 16 in the hammer. A limit pin 19 extends across the slot 16 formed in the hammer 13, and the limit pin 19 co-operates with two abutment surfaces 20 and 21 on opposite sides of a part circular recess 22 formed in the floating cam, so that the floating cam has limited relative pivotal movement with respect to the hammer equal to the difference between the space between the abutment surfaces 20 and 21, and the pin 19 diameter. The limited relative pivotal movement however is considerably less than the hammer pivotal movement.

The floating cam 17 is provided with a forwardly projecting portion 24 having a sear notch 25 therein, (the hammer sear notch having been ground away).

The hammer 13 is driven forwardly by means of the leaf spring 15 which engages a portion of the hammer remote from its pivotal axis, and the hammer is also provided with a thumb pad 27 for lifting away from the firing pin, this being standard to the pistol which was reworked.

In operation, the hammer is drawn rearwardly against the spring 15 and it carries the cam with it. The hammer is then eased forward, and the limit pin 19 in the hammer bears against the abutment surface 20 in the recess 22 of the floating cam 17. However at the rearward extension of movement of the floating cam 17, the sear notch 25 is engaged by the sear 12, so that the sear prevents full return of the hammer but the floating cam allows partial return. Actuation of the trigger releases the sear from the sear notch, and the hammer moves forwardly as in the orginal pistol, but by a shorter distance. Its forward movement is arrested by striking a firing pin which effects firing of the pistol. It should be noted that the cylinder is turned by the ratchet pall in drawing back the hammer, as in the pistol before modification. In the pistol utilised the movement of the hammer head was reduced from 1.1 inches to 0.500 inch and yet resulted in an effective ignition of the propellent contained within the cartridge.

Figure 3:
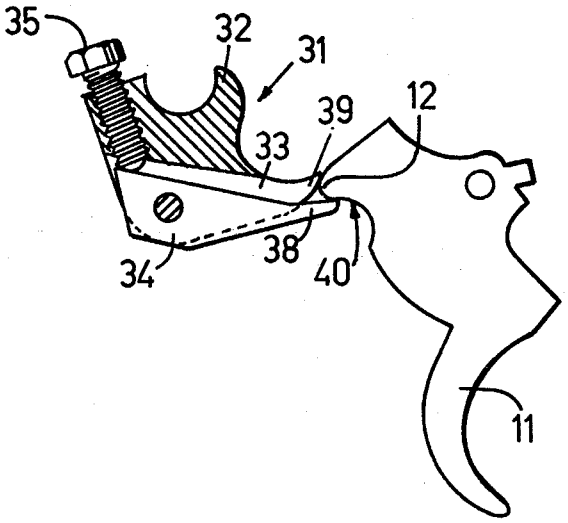
FIG. 3 illustrates the operation of the cam of FIG. 2.
Figure 2:
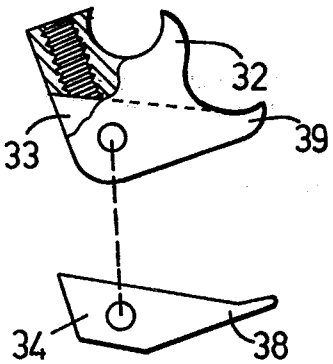
FIG. 2 is an enlarged exploded perspective view of a floating cam according to a second embodiment.

In target pistols some advantage is claimed for a so-called "roll off" long pull of the trigger as distinct from what is otherwise termed a "short crisp" pull of the trigger. In the second embodiment of FIGS. 2 and 3 this effect is achieved by utilising a floating cam assembly 31 which is similar in construction to that described in the first embodiment, but the floating cam assembly includes a cam body 32 itself provided with a narrow central slot 33 which contains a thin metal adjustable sear engagement stop member 34, the adjustment for the stop member with respect to the cam body 32 being effected by means of a screw 35 (FIG. 3 only). The adjustable sear engagement stop member 34 is provided with a finger 38 which co-operates with a finger 39 on the floating cam body 32 to form a gap which constitutes a sear notch 40 of adjustable width. If the sear notch 40 is made wider, more trigger movement is required to release the floating cam. If the sear face which engages the cam finger 39 is formed to have an arcuate shape with the trigger pivot at its centre, no increase in trigger resistance is felt during actuation, and this therefore results in a very smooth action of the trigger unlikely to cause any deflection of aim.

Figure 4:
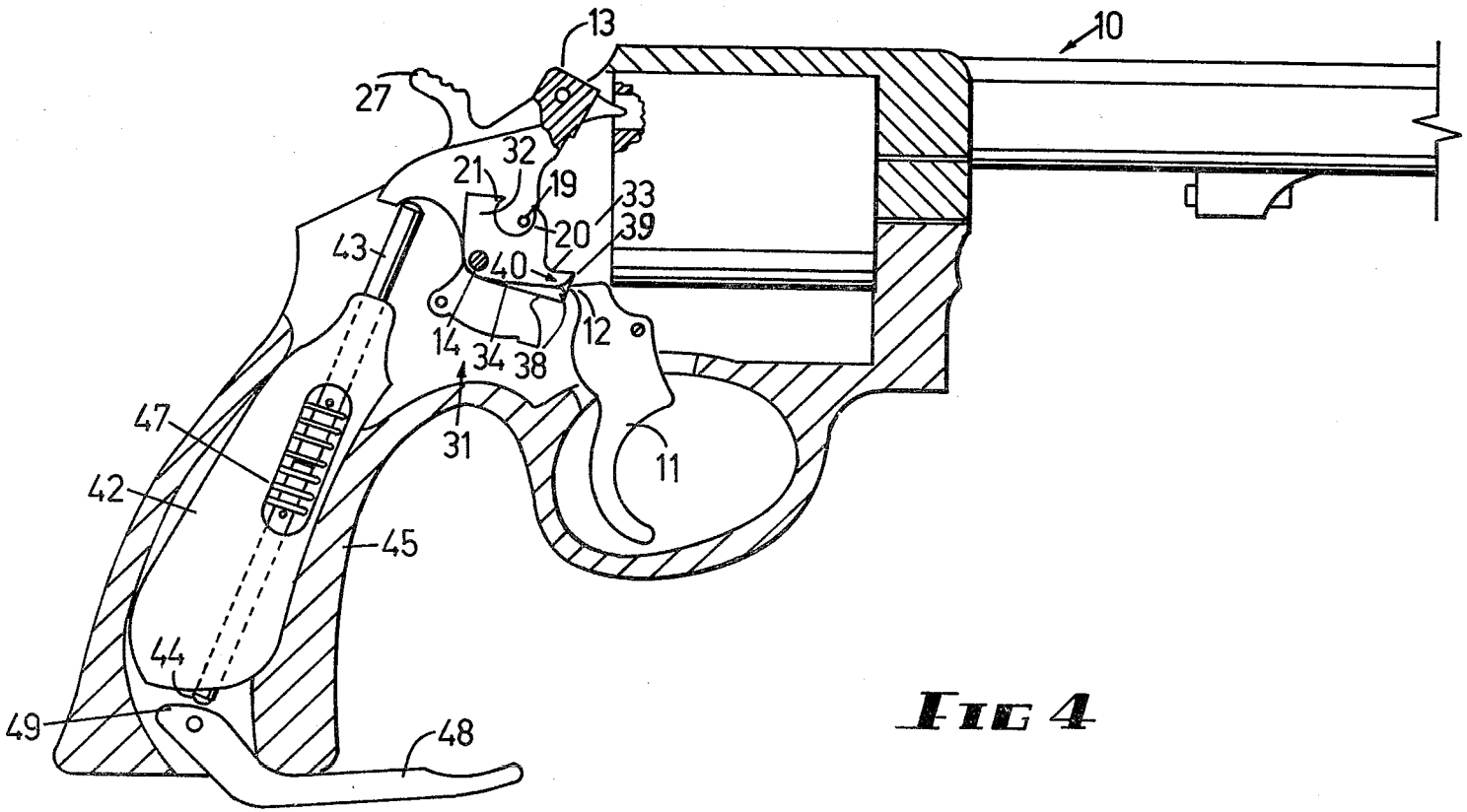
FIG. 4 is a view corresponding to FIG. 1 but of a third embodiment.

A third embodiment is illustrated in FIG. 4, which also utilizes the sear engagement stop member 34 in the narrow central slot 33 of cam body 32 as in the second embodiment, but without adjustment screw 35.

A housing 42 supports a pair of aligned coaxial pressure pins 43 and 44 for axial movement, the housing being contained within the hollow of the pistol handle 45. One of the pressure pins 43 extends outwardly from the housing to engage an abutment surface on the hammer 13 so as to urge the hammer towards the firing pin, while the other pressure pin 44 has means thereon which support a compression spring 47, the compression spring reacting against the two pins 43 and 44. A secondary lever 48 is pivoted to the bottom of the pistol handle 45, the secondary lever 48 being movable with a cam face 49 engaging the lower pin 44 so as to urge the lower pin 44 towards the upper pin 43 thereby further compressing the spring 47, and applying such great spring pressure that, in this embodiment, the hammer movement needs to be only 0.200 inches. This is found to be exceedingly effective in limiting inadvertent deflection of aim.

Figure 5:
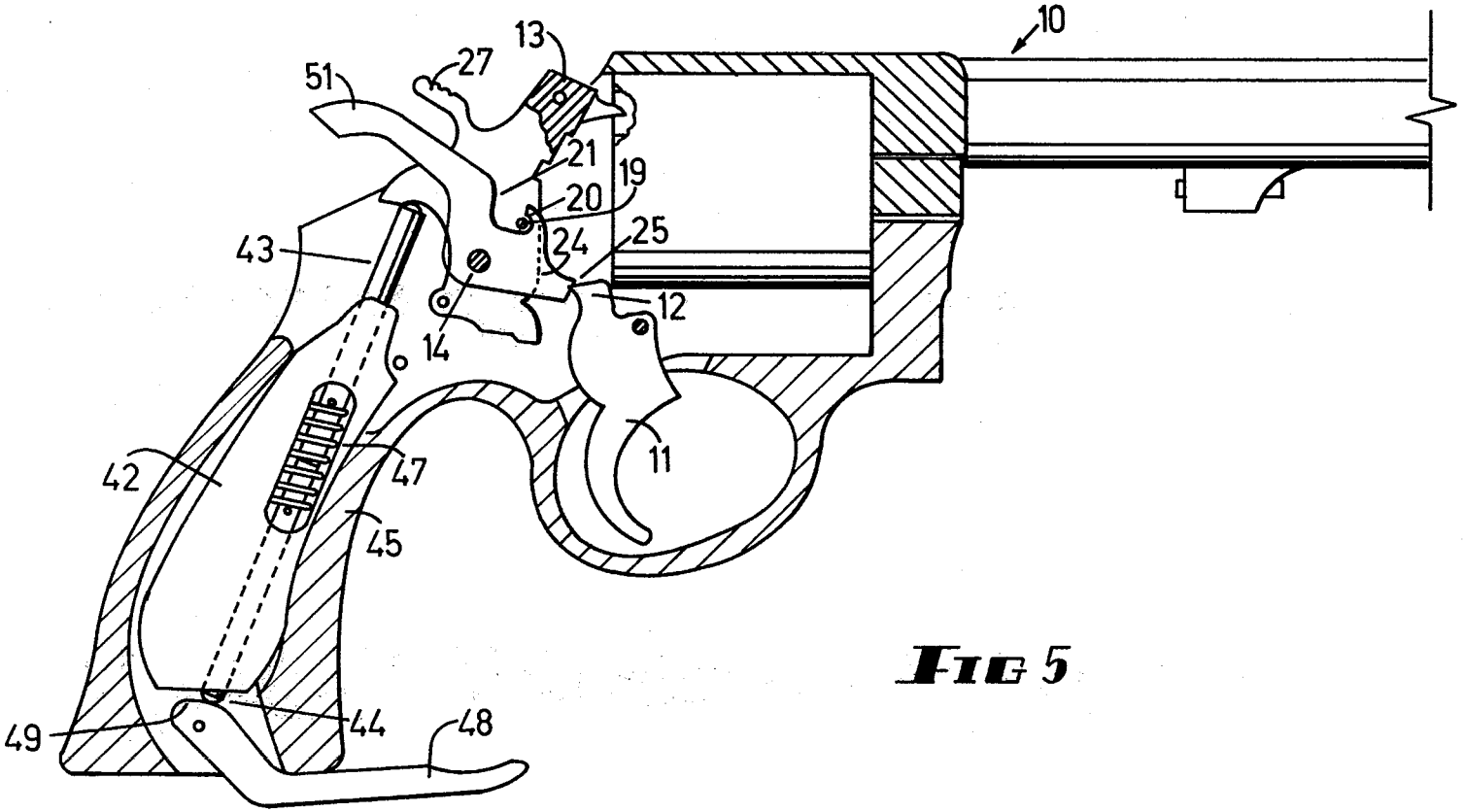
FIG. 5 is a view corresponding to FIGS. 1 and 4 but of a fourth embodiment.

In the fourth embodiment of FIG. 5 there is illustrated a further combination, wherein the pressure pin secondary lever principle shown in the third embodiment is employed with a floating cam which is generally similar to the first embodiment, but which has an extension lever 51 thereon.

Of course many variations may be introduced within the invention. For example in the fourth embodiment described, the pin which bears against the abutment surface on the hammer may be telescopic and may be pivotally mounted at its two ends, one end to the hammer and the other end to the secondary lever. In either case, the secondary lever may be positioned to its release position when the hammer is to be returned, the hammer return then being effective in only slightly compressing the spring. If desired the entire compression of the spring can be achieved by actuation of the secondary lever.

Various modification in structure and function may be made in the disclosed embodiments without departing from the scope of the invention as defined by the claims.

I claim:

1. A hammer type ignition system for a firearm having a hammer pivot about a pivot pin, comprising a sear, a floating cam also pivoted about said pivot pin and pivotally movable relative to the hammer, a sear engaging surface on the cam releasably engageable by the sear of a firearm trigger, co-operable means on the hammer and cam comprising a pair of abutment faces on opposite sides of a recess in the cam, and a limit pin on the hammer, said limit pin being accommodated in said recess and movable from one position where it engages one of the abutment faces to a second position where it engages the other.

2. A hammer type ignition system according to claim 1 comprising surfaces defining a notch in the cam, and wherein said sear engaging surface is the surface of the notch.

3. A hammer type ignition system according to claim 2 wherein said cam comprises a cam body and a stop member pivotally movable with respect to the hammer, and said notch is defined by surfaces of two fingers, one of which is on the cam body and the other on the stop member.

4. A hammer type ignition system according to claim 2 wherein said cam comprises a cam body and a stop member, both said body and said stop member being pivotally movable about said pivot pin, and also being pivotally movable about said pivot pin with respect to one another.

5. A hammer type ignition system according to claim 1 wherein said cam comprises a cam body and a stop member, pivot means joining the cam body and stop member for relative pivotal movement therebetween, a finger on the cam body and another finger on the stop member, surfaces on respective said fingers forming between them a notch, and screw threaded adjustment means between said cam body and stop member operable to adjust the notch width.

6. A hammer type ignition system according to claim 1 wherein the firearm trigger is pivoted about a trigger pivot pin, and said sear comprises a curved surface which has the axis of the trigger pivot pin as its centre of curvature.

7. A hammer type ignition system according to claim 1 further comprising a pair of pressure pins and a secondary lever having a cam surface thereon, one of the pins bearing against the hammer, the other bearing against the cam surface on the secondary lever, and a compression spring reacting on the pins, the secondary lever being movable to increase compression of the spring.

* * * * *